US011719443B2

(12) United States Patent
Zhou

(10) Patent No.: US 11,719,443 B2
(45) Date of Patent: Aug. 8, 2023

(54) REGULATING MECHANISM FOR REGULATING THE FLOWS FROM A PLURALITY OF GAS OUTLETS IN A FUEL GAS VALVE

(71) Applicant: NINGBO RICHEN ELECTRICAL APPLIANCE CO., LTD, Ningbo (CN)

(72) Inventor: Yin Zhou, Ningbo (CN)

(73) Assignee: NINGBO RICHEN ELECTRICAL APPLIANCE CO., LTD, Ningbo (CN)

( * ) Notice: Subject to any disclaimer, the term of this patent is extended or adjusted under 35 U.S.C. 154(b) by 0 days.

(21) Appl. No.: 17/592,116

(22) Filed: Feb. 3, 2022

(65) Prior Publication Data

US 2022/0163207 A1 May 26, 2022

Related U.S. Application Data

(63) Continuation of application No. 16/585,244, filed on Sep. 27, 2019, now Pat. No. 11,280,497.

(30) Foreign Application Priority Data

Apr. 19, 2019 (CN) ..... 201910320117.0
Apr. 19, 2019 (CN) ..... 201920539976.4

(51) Int. Cl.
*F24B 1/18* (2006.01)
*F24C 3/12* (2006.01)

(52) U.S. Cl.
CPC ..... *F24B 1/1808* (2013.01); *F24C 3/12* (2013.01)

(58) Field of Classification Search
None
See application file for complete search history.

*Primary Examiner* — Jason Lau
(74) *Attorney, Agent, or Firm* — Charles C. Achkar; Ostrolenk Faber LLP.

(57) ABSTRACT

The present invention discloses a regulating mechanism regulating the flows from a plurality of gas outlets in a fuel gas valve, comprising an actuator, a push rod, a presser plate assembly, regulating rods and a valve body. Wherein the valve body has a plurality of gas outlets, a regulating rod is provided in each regulating port which exists between the gas inlet and each gas outlet, a resetting device is provided between each regulating rod and the valve body, and the actuator drives the push rod which is around by the regulating ports to move along the axis. The push rod causes the presser plate assembly to move up and down to press or relax the regulating rods and simultaneously change the degree of opening between the head portion of each regulating rod and the corresponding regulating port so that the flow from each gas outlet changes synchronously.

15 Claims, 14 Drawing Sheets

REGULATING MECHANISM FOR REGULATING THE FLOWS FROM A PLURALITY OF GAS OUTLETS IN A FUEL GAS VALVE

CROSS REFERENCE TO RELATED APPLICATIONS

The present application is a continuation of U.S. application Ser. No. 16/585,244 filed Sep. 27, 2019, which claims priority to China Application No. 201910320117.0 filed on Apr. 19, 2019 and China Application No. 201920539976.4 filed Apr. 19, 2019, the subject matter of each of which are incorporated herein by reference in their entirety.

TECHNICAL FIELD

The present invention relates to a regulating mechanism for regulating flows from two or more gas outlets, and in particular to a regulating mechanism for regulating flows from a plurality of gas outlets in a fuel gas valve.

BACKGROUND ART

A fireplace is a traditional heating device which is not only safe but also efficient. Besides the heating function, the fireplace can be used as decor to give a nice setting. With the ever-changing manufacture and life, people have higher and higher requirements for fireplaces. A new gas fireplace with a main burner and an auxiliary burner, or even a plurality of burners, has also come into being. Two or more gas outlets need to be equipped for the fuel gas valve of this new type of gas fireplace to supply gas independently. In addition, in order to balance and/or unify the flame heights of two or more burners, the gas flows from two or more gas outlets in the gas valve need to be simultaneously regulated when the flame is regulated, namely, when the flow of the fuel gas valve is regulated.

However, in an existing fuel gas valve, two or more independent regulating mechanisms are usually used to regulate the flows from a plurality of gas outlets, and the synchronous regulation of the two or more gas outlets is controlled by a program. The structure with two or more independent regulating mechanisms is complex and the cost is higher. In addition, since two or more driving components need to be controlled simultaneously, it becomes more difficult to achieve synchronous control and the regulating mechanisms are prone to faults.

SUMMARY OF THE INVENTION

The technical problem to be solved by the present invention is to provide a regulating mechanism for regulating flows from a plurality of gas outlets in a fuel gas valve. Driven by one actuator, one presser plate assembly can synchronously regulate the flows from two or more gas outlets in a fuel gas valve.

The technical solution adopted for the present invention to solve the above-mentioned technical problem is as follows: A regulating mechanism for regulating flows from a plurality of gas outlets in a fuel gas valve comprises an actuator, a push rod, a presser plate assembly, regulating rods and a valve body. The valve body is provided with one gas inlet and two or more gas outlets, a regulating port is provided between said gas inlet and said at least two gas outlets from which the flows need to be regulated, that is, said each regulating port communicates with said gas inlet, a regulating rod is provided on the axis of each of said regulating ports, the head portion of said regulating rod is equipped with a conical head, and a resetting device is provided between each of said regulating rods and said valve body; said regulating ports are arranged around said push rod, the output shaft of said actuator and said push rod are coaxially arranged, and said presser plate assembly comprises a presser plate and is arranged on the end portion of said regulating rod.

In a further technical solution, a regulating device is provided at least in a position corresponding to one said regulating rod on said presser plate assembly, said regulating device comprises a regulating rod pressing head, and the surface of the head portion of said regulating rod pressing head is pressed on the end portion of said regulating rod.

In a further technical solution, the relative height of the surface of the head portion of said regulating rod pressing head relative to the surface of the presser plate is adjustable.

In a further technical solution, the conical head of said regulating rods is a conical rubber sealing element and said rubber sealing element is fitted onto the head portion of said regulating rod.

When the regulating mechanism works, the output shaft of said actuator moves to drive said push rod to move forward, thus causing said push rod to push said presser plate assembly to move in a direction away from said regulating rod, which further causes said regulating rod to move upward under the action of said resetting device so that the opening degree of the passage formed between the conical head of said regulating rod and each of said regulating port is reduced, that is, the flow passing through each corresponding gas outlet is synchronously reduced.

When it is necessary to increase the flows, the output shaft of the actuator moves in an opposite direction to drive said push rod to move downward, thus causing said presser plate assembly to move downward, and as said presser plate assembly presses said regulating rods to move downward together, the opening degree of the passage formed between the conical head of said regulating rods and each of said regulating ports is increased, that is, the flow passing through each gas outlet is synchronously increased.

The gas coming out of each gas outlet will additionally flow through an independent passage, and a switching device, for example, solenoid valve, is provided in said passage to control the opening and closing of said independent passage. Through said switching device, the fuel gas can be independently supplied to each burner of the fireplace and the flame can be regulated.

In addition, owing to manufacturing errors during the manufacturing of said regulating rods, said presser plate assembly will press on said regulating rods at varied degrees. By adjusting the relative height of the surface of the head portion of the regulating rod pressing head relative to the surface of the presser plate to compensate for the manufacturing errors of said regulating rods, said presser plate assembly can press on the regulating rods to the same degree so that the opening degrees of the regulating ports can be the same or of the same ratio.

In addition, since the burners connected to different gas outlets on the gas fireplace may require different amounts of gas to be supplied, the opening degrees of said regulating ports can be different, and the flows passing through said regulating ports are synchronously regulated at a certain ratio or according to a certain rule.

Further, said actuator and said push rod can be integrated to become a linearly driving actuator, for example, a proportion electromagnet or a linearly driving motor.

Further, when said presser plate assembly moves up and down relative to the valve body, a guide device is provided between said presser plate and said valve body. For example, the up-and-down movements of said presser plate can be guided by providing guide support points on said presser plate and/or said valve body, or providing a guide rod.

Further, said regulating port has a certain baseline flow, that is, when the flow is regulated to a minimum flow through said regulating port, said regulating port is not completely closed, or said regulating port is set to have a minimum flow.

Further, when the flow is regulated to a minimum flow through said regulating port, said regulating port is completely closed, but a minimum-flow port is provided in parallel with said regulating port between said gas inlet and said gas outlet and the minimum flow from said gas inlet to each of said gas outlets is determined by said minimum-flow port.

Further, a groove is provided in said valve body, said presser plate assembly is embedded into said groove, a presser-plate cover plate is provided outside said presser plate assembly, and said presser-plate cover plate and said groove encapsulate said presser plate assembly inside said valve body.

Further, an operating port is provided on said presser-plate cover plate, and the relative height of the surface of the head portion of said regulating rod pressing head relative to the surface of said presser plate can be adjusted through said operating port.

Further, an operating cover is provided on said operating port and said operating cover seals up the space where said presser plate assembly is located.

Further, the end portion of said regulating rod pressing head is equipped with a slot in a certain shape, for example, hexagonal slot, straight slot or square slot, and the relative height can be adjusted by use of a certain tool.

Compared with the prior art, the present invention has the following advantages: One actuator simultaneously drives two or more regulating rods to move so that two or more regulating ports can simultaneously and synchronously regulate the gas outlet flows, the flame heights of different burners of a gas fireplace can match each other and be relatively consistent at any time, and the effects of the manufacturing errors during the manufacturing of different parts and components can be reduced; the present invention is structurally simple and is applicable to fuel gas control valves in most gas fireplaces with two or more burners.

Figure 1:
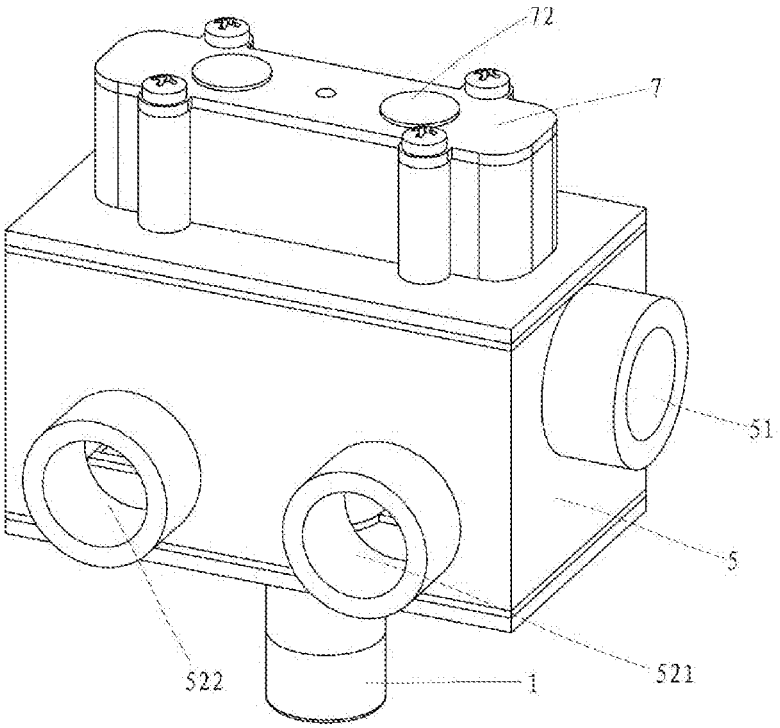
FIG. 1 is a three-dimensional view showing the structure of embodiment 1 of the present invention.
Figure 2:
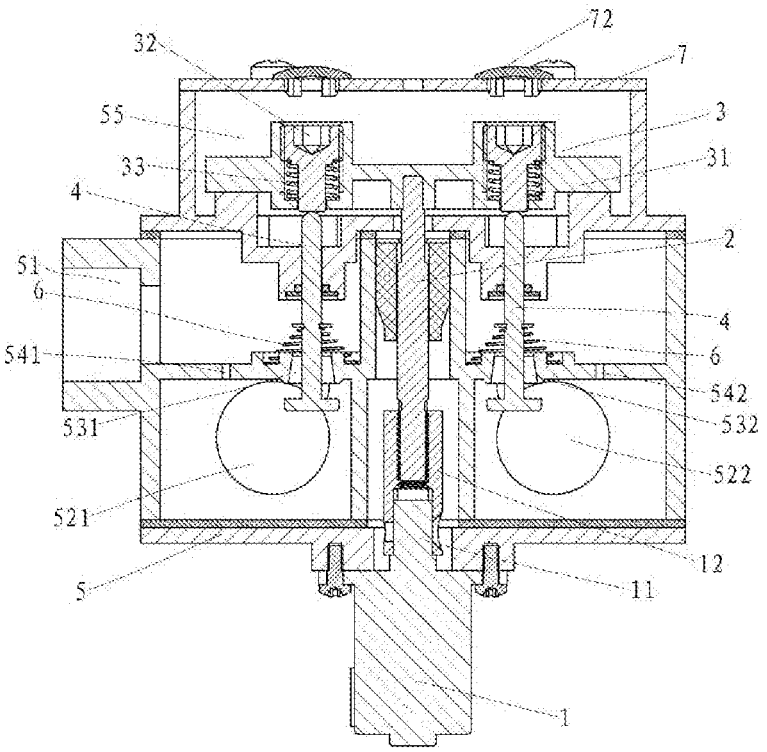
FIG. 2 is a cutaway view of embodiment 1 of the present invention in the position where the flows are maximum.
Figure 3:
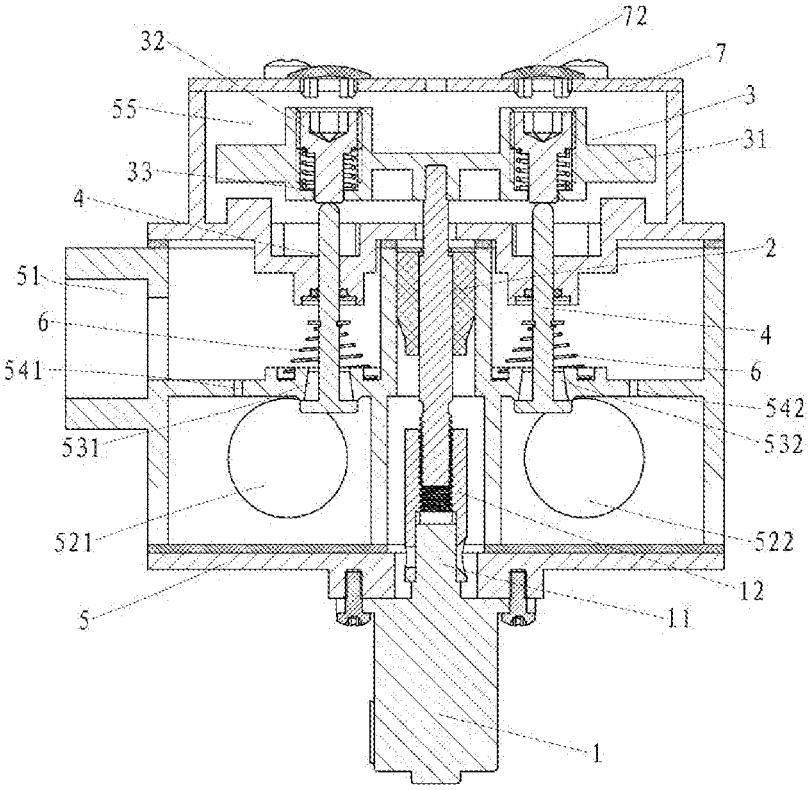
FIG. 3 is a cutaway view of embodiment 1 of the present invention in the position where the flows are minimum.
Figure 4:
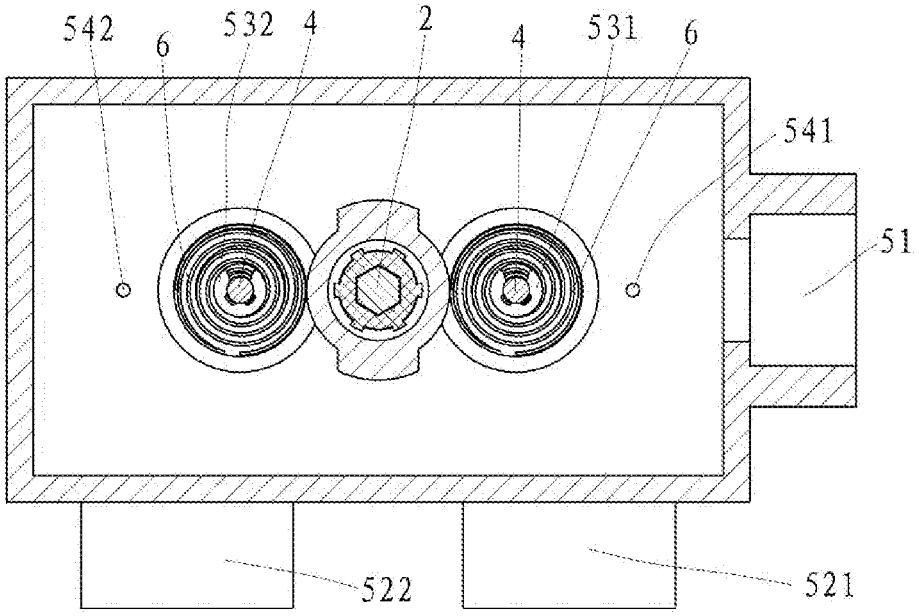
FIG. 4 is a cutaway view of embodiment 1 of the present invention in the position of the gas inlet.
Figure 5:
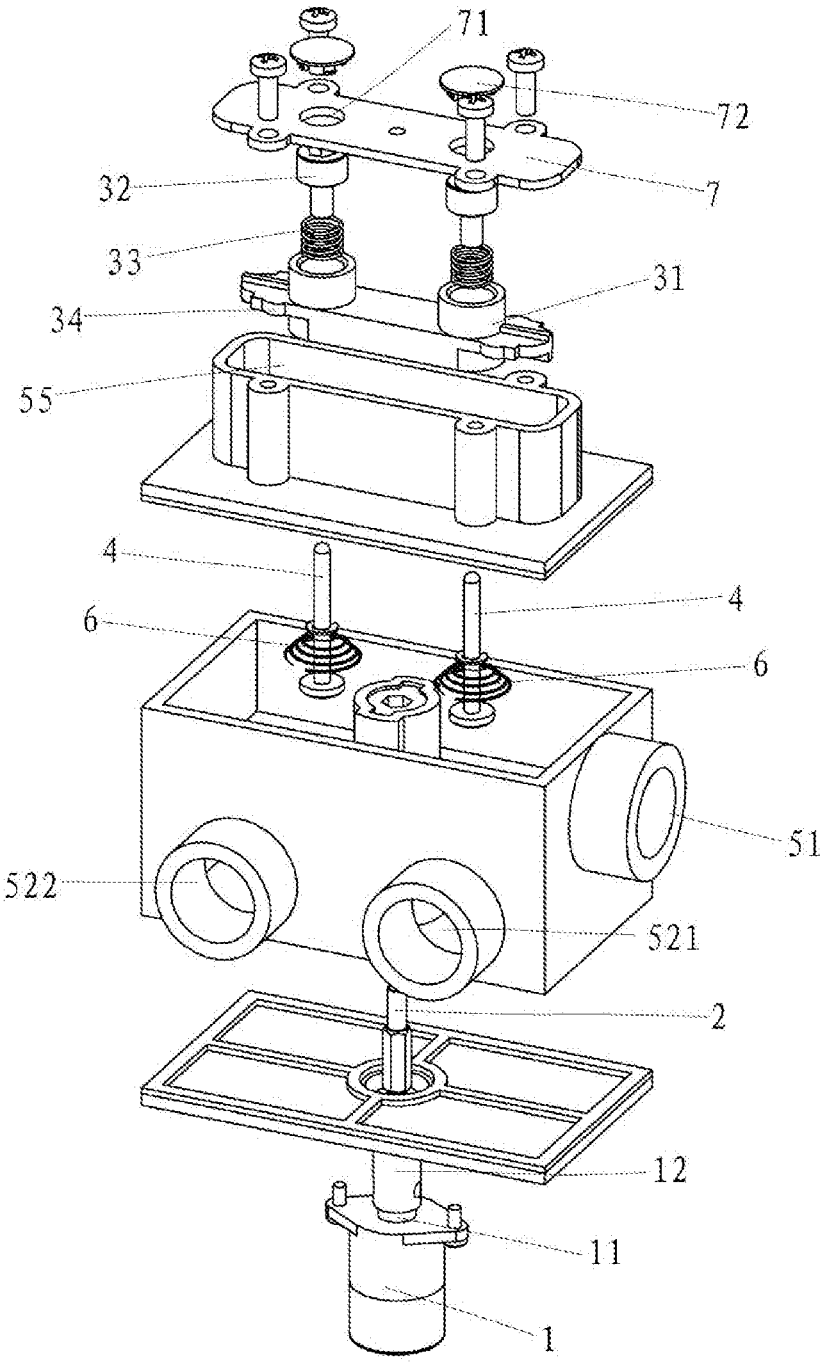
FIG. 5 is an exploded view showing the structure of embodiment 1 of the present invention.
Figure 6:
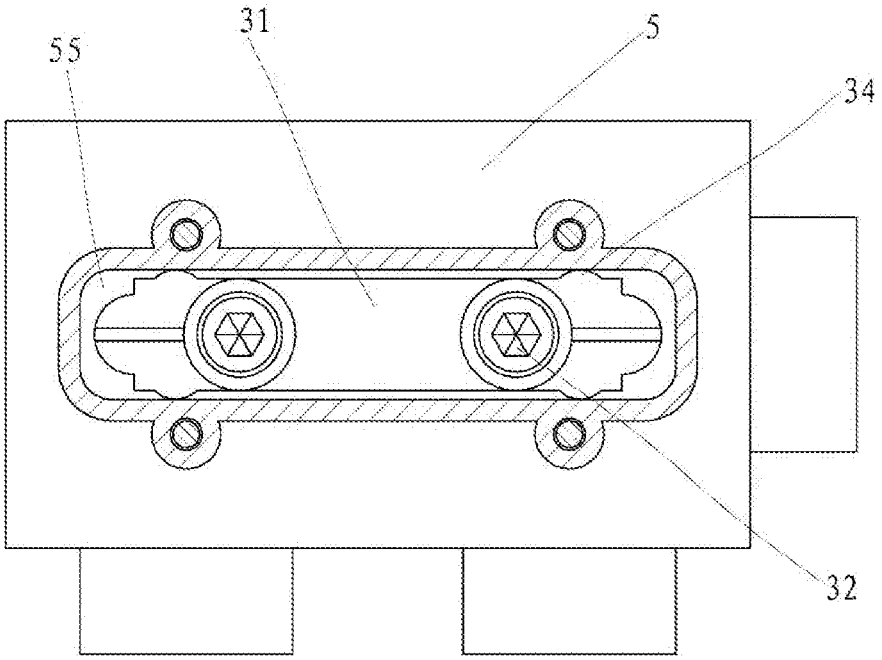
FIG. 6 shows the fit between the groove and the presser plate assembly on the valve body of embodiment 1 of the present invention.

Description of reference numerals in the drawings: 1—actuator; 2—push rod; 3—presser plate assembly; 4—regulating rod; 5—valve body; 6—resetting device; 7—presser-plate cover plate; 11—actuator output shaft; 12—commutator; 31—presser plate; 32—regulating rod pressing head; 33—locking spring; 34—guide support point A; 35—regulating spring; 36—guide rod; 37—guide hole; 38—first balancing spring; 39—second guide rod; 310—first spherical bearing; 41—conical head; 51—gas inlet; 52—gas outlet; 521—first gas outlet; 522—second gas outlet; 523—third gas outlet; 53—regulating port; 531—first regulating port; 532—second regulating port; 533—third regulating port; 54—minimum-flow port; 541—first minimum-flow port, 542—second minimum-flow port; 543—third minimum-flow port; 55—groove; 56—guide support point B; 71—operating port; 72—operating cover; 73—regulating screw; 74—second balancing spring; 75—second spherical bearing

PARTICULAR EMBODIMENTS

The following further describes the present invention in combination with the drawings and embodiments. The following embodiments are intended to describe the present invention, but not to restrict the scope of the present invention.

Embodiment 1

As shown in FIGS. 1 to 6, a regulating mechanism for regulating flows from a plurality of gas outlets in a fuel gas valve comprises an actuator (1), a push rod (2), a presser plate assembly (3), a regulating rod (4) and a valve body (5). In this embodiment 1, the actuator (1) is a rotationally driving motor, the valve body (5) is provided with one gas inlet (51) and two gas outlets, i.e., a first gas outlet (521) and a second gas outlet (521), and a first regulating port (531) from the gas inlet (51) to the first gas outlet (521) and a second regulating port (532) from the gas inlet (51) to the second gas outlet (522) are provided; a regulating rod (4) is respectively provided on the axes of the first regulating port (531) and the second regulating port (532), the diameter of the head portion of the regulating rod (4) is greater than the diameter of the opening of said first regulating port (531) or second regulating port (532), a resetting device (6) is provided between each regulating rod (4) and the valve body (5), and in this embodiment 1, the resetting device (6) is a compression spring arranged between the regulating rod (4) and the first regulating port (531) or second regulating port (532), the first regulating port (531) and the second regulating port (532) are arranged around the push rod (2), the output shaft (11) of the actuator (1) and the push rod (2) are coaxially arranged, the output shaft (11) is connected to the push rod (2) through a commutator (12), the presser plate assembly (3) comprises a presser plate (31) and is arranged on the end portion of the regulating rod (4), the end portion of the regulating rod (4) is spherical, and in this embodiment 1, the push rod (2) and the presser plate (31) are fixedly connected. In this embodiment 1, a regulating device is provided in a position corresponding to said regulating rod (4) on said presser plate assembly (3), said regulating device comprises a regulating rod pressing head (32), and the surface of the head portion of the regulating rod pressing head (32) is pressed on the end portion of said regulating rod (4), and the end portion of is the regulating rod pressing head (32) is a hexagonal recessed slot. The regulating rod pressing head (32) is connected with the presser plate (31) via a screw thread, and a locking spring (33) is provided between the regulating rod pressing head (32) and the presser plate (31).

A first minimum-flow port (541) is provided in parallel with the first regulating port (531) between the gas inlet (51) and the first gas outlet (521), and a second minimum-flow port (542) is provided in parallel with the second regulating port (532) between the gas inlet (51) and the second gas outlet (522).

A groove (55) is provided in the valve body (5) and the presser plate is set inside the groove (55), a presser-plate cover plate (7) is provided outside the presser plate assembly (3), an operating port (71) is provided on the presser-plate cover plate (7), an operating cover (72) is provided on the operating port (71), and the operating cover (72) is installed in the operating port (71).

When the regulating mechanism works, the output shaft (11) of the actuator (1) rotates and drives the push rod (2) to move upward with the aid of the commutator (12), and the push rod (2) pushes the presser plate assembly (3) to move upward, and the upward movement of the presser plate assembly (3) causes the regulating rod (4) to move upward under the action of the resetting device (6) so that the opening degree of the passage formed between the head portion of the regulating rod (4) and the first regulating port (531) or the second regulating port (532) is reduced, that is, the flows passing through the first gas outlet (521) and the second gas outlet (522) are synchronously reduced.

When it is necessary to increase the flows, the output shaft (11) of the actuator (1) rotates in an opposite direction and the push rod (2) is driven to move downward with the aid of the commutator (12), and since the push rod (2) is fixedly connected with the presser plate (31), the presser plate assembly (3) is driven to move downward, and the downward movement of the presser plate assembly (3) presses the regulating rods (4) to move downward together so that the opening degree of the passage formed between the head portion of said regulating rod (4) and the first regulating port (531) or the second regulating port (532) is increased, that is, the flows passing through the first gas outlet (521) and the second gas outlet (522) are synchronously increased.

The gas coming out of each gas outlet (52) will additionally pass through an independent passage, and a switching device, for example, solenoid valve, is provided in said passage to control the opening and closing of said independent passage. Through said switching device, the fuel gas can be independently supplied to each burner of the fireplace and the flame can be regulated.

Since the first minimum-flow port (541) and the second minimum-flow port (542) are provided, when the regulating mechanism in the present embodiment is used to regulate the flows, the minimum flow from the first gas outlet (521) is the flow passing through the first minimum-flow port (541), and the minimum flow from the second gas outlet (522) is the flow passing through the second minimum-flow port (542).

In addition, owing to manufacturing errors during the manufacturing of the regulating rods (4), the presser plate assembly (3) will press the regulating rods (4) to different degrees, and to solve this problem, the operating cover (72) can be removed from the corresponding operating port (71) and a tool such as an inner hexagon spanner can be used to rotate the regulating rod pressing head (32) to adjust the relative height of the surface of the head portion of the regulating rod pressing head (32) relative to the surface of the presser plate (31) to compensate for the manufacturing errors of the regulating rods (4). Thus, the presser plate assembly (3) can press the regulating rods (4) to the same degree and the opening degrees of the first regulating port (531) and the second regulating port (532) can be the same or be of the same ratio. In addition, since the locking spring (33) is provided, the regulating rod pressing head (32) can be locked right after its height is adjusted so that it will not be loosened because of the threaded connection between the regulating rod pressing head (32) and the presser plate (31).

A guide support point A (34) is further provided on the presser plate (31) is such that, when the push rod (2) drives the presser plate assembly (3) to move up and down, the positioning guide between the guide support point A (34) and the side wall of the groove (55) in the valve body (5) can prevent the presser plate assembly (3) from rotating askew.

Embodiment 2

Figure 7:
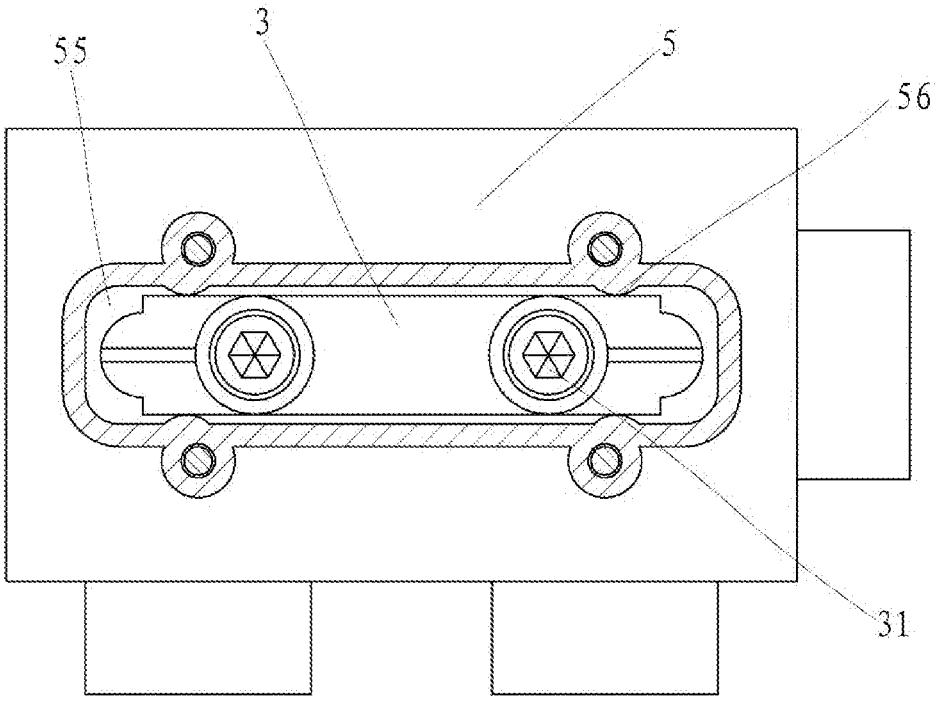
FIG. 7 shows the fit between the groove and the presser plate assembly on the valve body of embodiment 2 of the present invention.

As shown in FIG. 7, the regulating mechanism for regulating flows from a plurality of gas outlets in a fuel gas valve in this embodiment 2 is based on the embodiment 1, wherein the guide support point A (34) is removed from the presser plate (31), but a guide support point B (56) is provided on the side wall of the groove (55) in the valve body (5) such that, when the push rod (2) drives the presser plate assembly (3) to move up and down, the positioning guide between guide support point B (56) and the side of the presser plate (31) can prevent the presser plate assembly (3) from rotating askew.

Embodiment 3

Figure 8:
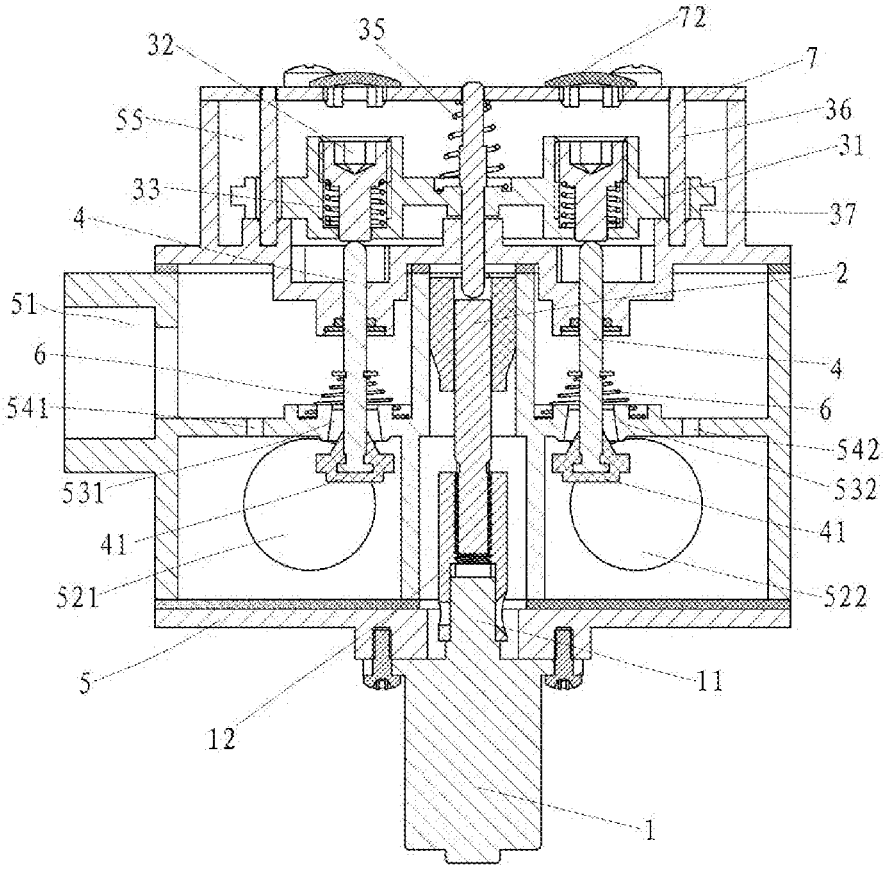
FIG. 8 is a cutaway view of embodiment 3 of the present invention in the position where the flows are maximum.
Figure 9:
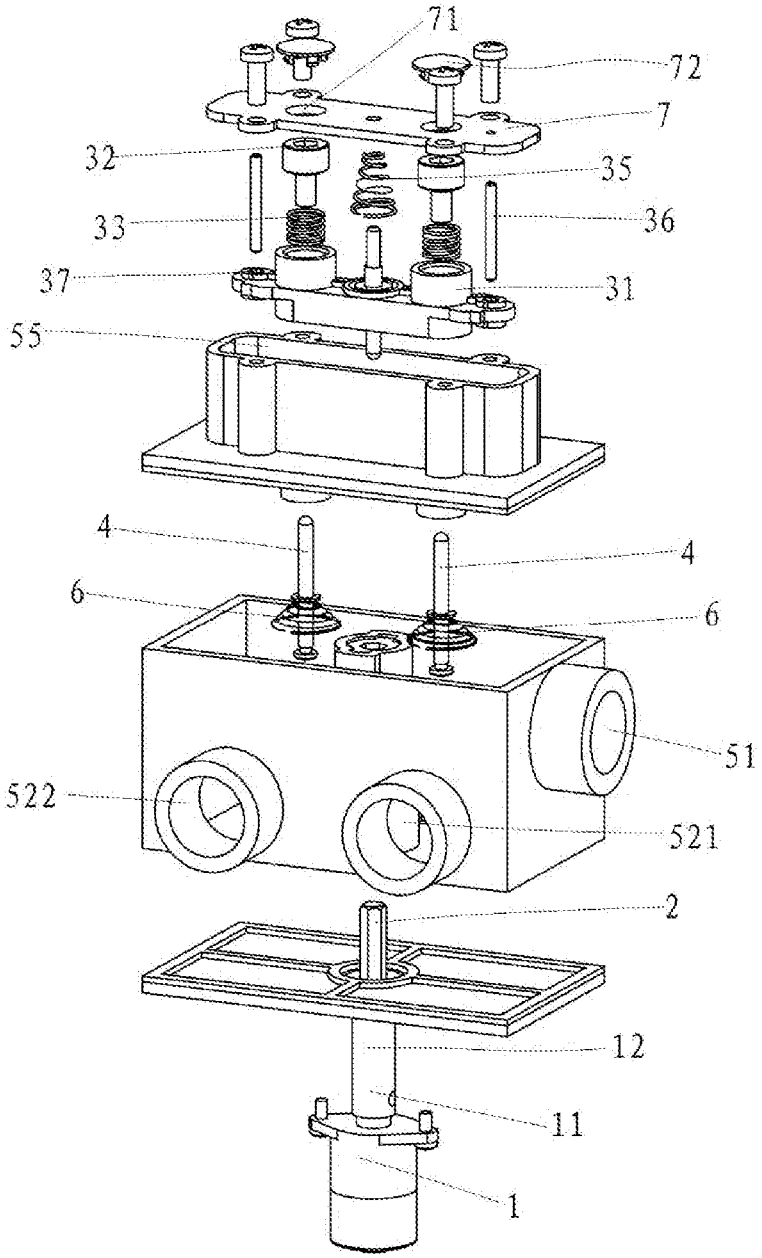
FIG. 9 is an exploded view showing the structure of embodiment 3 of the present invention.
Figure 10:
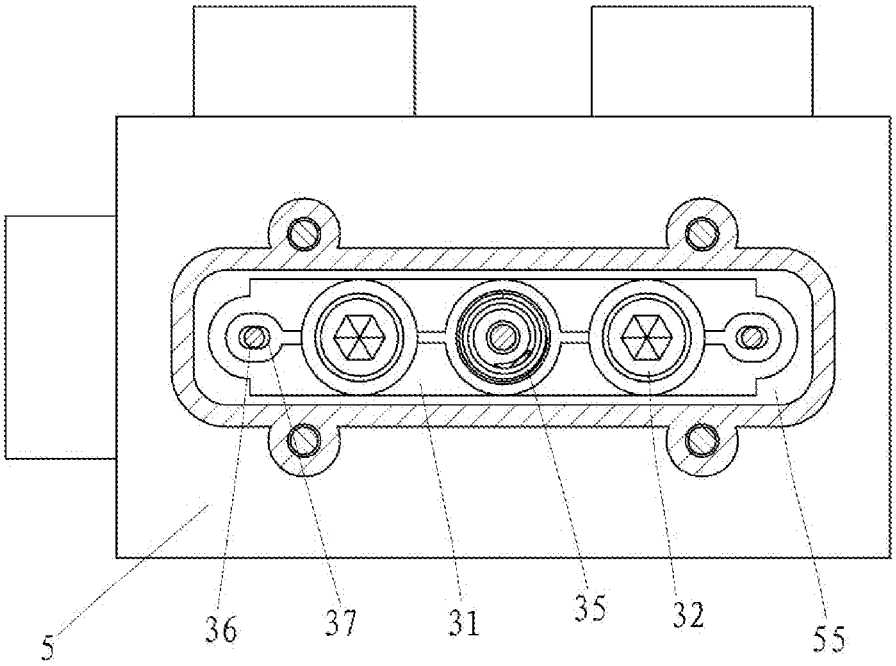
FIG. 10 shows the fit between the groove and the presser plate assembly on the valve body of embodiment 3 of the present invention.

As shown in FIGS. 8 to 10, a regulating mechanism for regulating flows from a plurality of gas outlets in a fuel gas valve comprises an actuator (1), a push rod (2), a presser plate assembly (3), a regulating rod (4) and a valve body (5). In this embodiment 3, the actuator (1) is a rotationally driving motor, the valve body (5) is provided with one gas inlet (51) and two or more gas outlets, and in this embodiment 3, the valve body is provided with two gas outlets, namely, a first gas outlet (521) and a second gas outlet (522), and a first regulating port (531) from the gas inlet (51) to the first gas outlet (521) and a second regulating port (532) from the gas inlet (51) to the second gas outlet (522) are provided; a regulating rod (4) is respectively provided on the axes of the first regulating port (531) and the second regulating port (532), the diameter of the head portion of the regulating rod (4) is greater than the diameter of the opening of said first regulating port (531) or second regulating port (532), the head portion of the regulating rod (4) is equipped with a conical head (41), the conical head (41) of the regulating rod (4) is a rubber sealing cushion fitted onto the head portion of the regulating rod (4), a resetting device (6) is provided between each regulating rod (4) and the valve body (5), and in this embodiment 3, the resetting device (6) is a compression spring provided between the regulating rod (4) and the first regulating port (531) or second regulating port (532), the first regulating port (531) and the second regulating port (532) are symmetrically arranged around the push rod (2), the output shaft (11) of the actuator (1) and the push rod (2) are coaxially arranged, the output shaft (11) is connected to the push rod (2) through the commutator (12), the presser plate assembly (3) comprises a presser plate (31) and is provided on the end portion of the regulating rod (4), the end portion of the regulating rod (4) is spherical, and in this embodiment (3), the push rod (2) and the presser plate assembly (3) are connected via contact, the push rod (2) and the regulating rod (4) are located on the same side of the presser plate assembly (3), a regulating spring (35) is provided in the presser plate assembly (3) on the other side opposite to the push rod (2), the regulating spring (35) is in a pre-compressed state, and the pre-compression force of the regulating spring (35) is by far greater than the resultant of pre-compression forces of all resetting devices (6). In this embodiment 3, a regulating device is provided in a position corresponding to said regulating rod (4) on the presser plate assembly (3), said regulating device comprises a regulating rod pressing head (32), and the surface of the head portion of the regulating rod pressing head (32) is pressed on the end portion of the regulating rod (4), and the end portion of the regulating rod pressing head (32) is a hexagonal recessed slot. The regulating rod pressing head (32) is connected with the presser plate (31) through a screw thread, and a locking spring (33) is provided between the regulating rod pressing head (32) and the presser plate (31).

A first minimum-flow port (541) is provided in parallel with the first regulating port (531) between the gas inlet (51) and the first gas outlet (521), and a second minimum-flow port (542) is provided in parallel with the second regulating port (532) between the gas inlet (51) and the second gas outlet (522).

A groove (55) is provided in the valve body (5) and the presser plate is is arranged inside the groove (55), a presser-plate cover plate (7) is provided outside the presser plate assembly (3), an operating port (71) is provided on the presser-plate cover plate (7), an operating cover (72) is provided on the operating port (71), and the operating cover (72) is installed inside the operating port (71).

When the regulating mechanism works, the output shaft (11) of the actuator (1) rotates and drives the push rod (2) to move upward with the aid of the commutator (12), and the push rod (2) pushes the presser plate assembly (3) to move upward, and the upward movement of the presser plate assembly (3) causes the regulating rod (4) to move upward under the action of the resetting device (6) so that the opening degree of the passage formed between the conical head (41) of the regulating rod (4) and the first regulating port (531) or the second regulating port (532) is reduced, that is, the flows passing through the first gas outlet (521) and the second gas outlet (522) are synchronously reduced.

When it is necessary to increase the flows, the output shaft (11) of the actuator (1) rotates in an opposite direction and the push rod (2) is driven to move downward with the aid of the commutator (12), and, since the pre-compression force of the regulating spring (35) is by far greater than the resultant of the pre-compression forces of all resetting devices (6), the presser plate assembly (3) is pressed to move downward under the action of the regulating spring (35), causing the regulating rod (4) to move downward together such that the opening degree of the passage formed between the conical head (41) of the regulating rod (4) and the first regulating port (531) or the second regulating port (532) is increased, that is, the flows passing through the first gas outlet (521) and the second gas outlet (522) are synchronously increased.

The gas coming out of each gas outlet (52) will additionally pass through an independent passage, and a switching device, for example, solenoid valve, is provided in said passage to control the opening and closing of said independent passage. Through said switching device, the fuel gas can be independently supplied to each burner of the fireplace and the flame can be regulated.

Since the first minimum-flow port (541) and the second minimum-flow port (542) are provided, when the regulating mechanism in the present embodiment is used to regulate the flows, the minimum flow from the first gas outlet (521) is the flow passing through the first minimum-flow port (541), and the minimum flow from the second gas outlet (522) is the flow passing through the second minimum-flow port (542).

In addition, owing to manufacturing errors during the manufacturing of the regulating rods (4), the presser plate assembly (3) will press the regulating rods (4) to different degrees, and to solve this issue, an operating cover (72) can be removed from the corresponding operating port (71) and a tool such as an inner hexagon spanner can be used to rotate the regulating rod pressing head (32) to adjust the relative height of the surface of the head portion of the regulating rod pressing head (32) relative to the surface of the presser plate (31) to compensate for the manufacturing errors of the regulating rods (4) so that the presser plate assembly (3) can press the regulating rods (4) to a same degree and the opening degrees of the first regulating port (531) and the second regulating port (532) can be the same or of the same ratio. In addition, since the locking spring (33) is provided, the regulating rod pressing head (32) can be locked right after its height is adjusted so that it will not be loosened because of the threaded connection between the regulating rod pressing head (32) and the presser plate (31).

The presser plate assembly (3) is further provided with a guide rod (36) and a guide hole (37), the guide rod (36) passes through the guide hole (37) and is fixed onto the valve body (5) such that, when the push rod (2) drives the presser plate assembly (3) to move up and down, the positioning guide of the guide rod (36) can prevent the presser plate assembly (3) from rotating askew.

Embodiment 4

Figure 11:
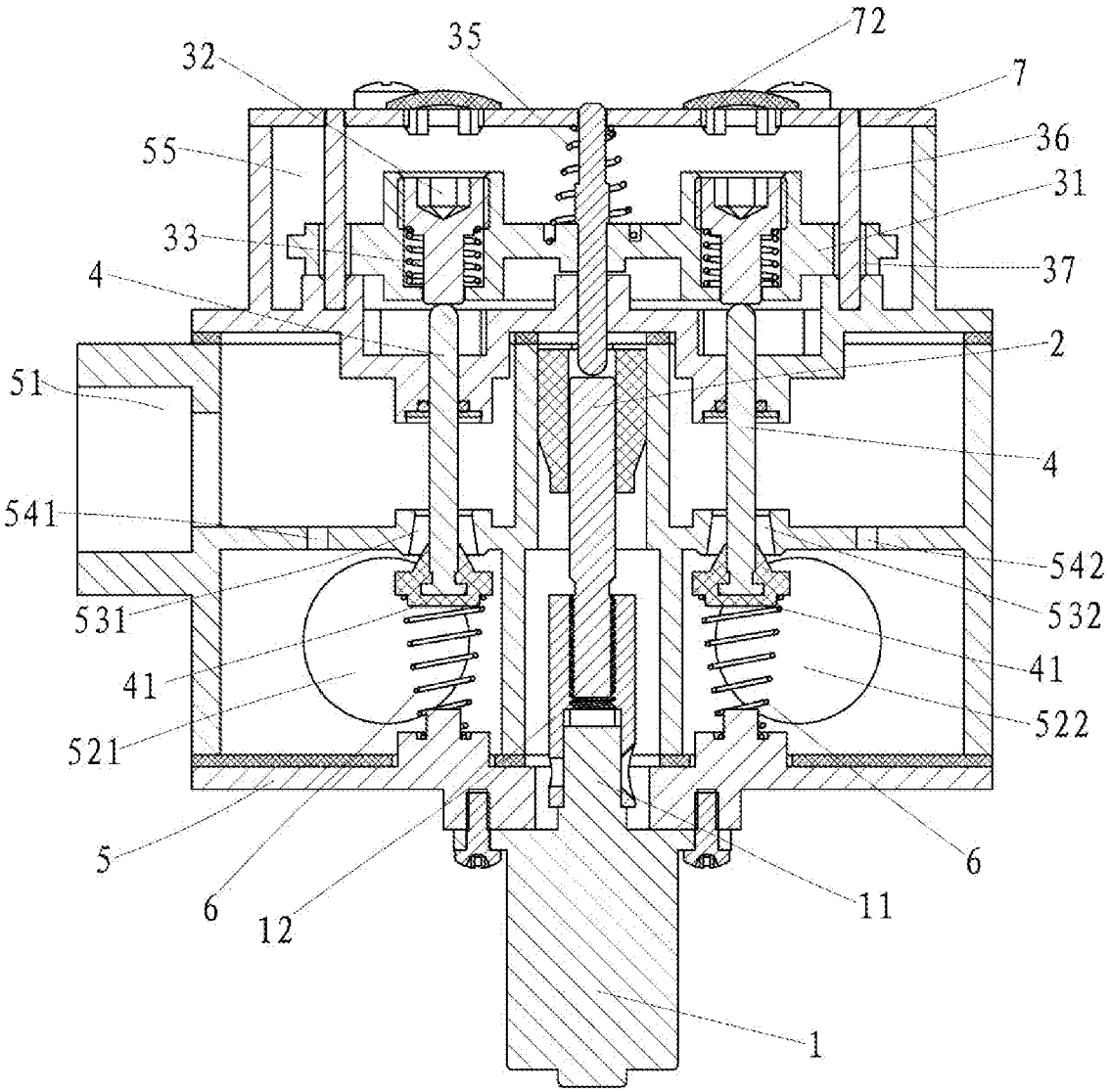
FIG. 11 is a cutaway view of embodiment 4 of the present invention in the position where the flows are maximum.
Figure 12:
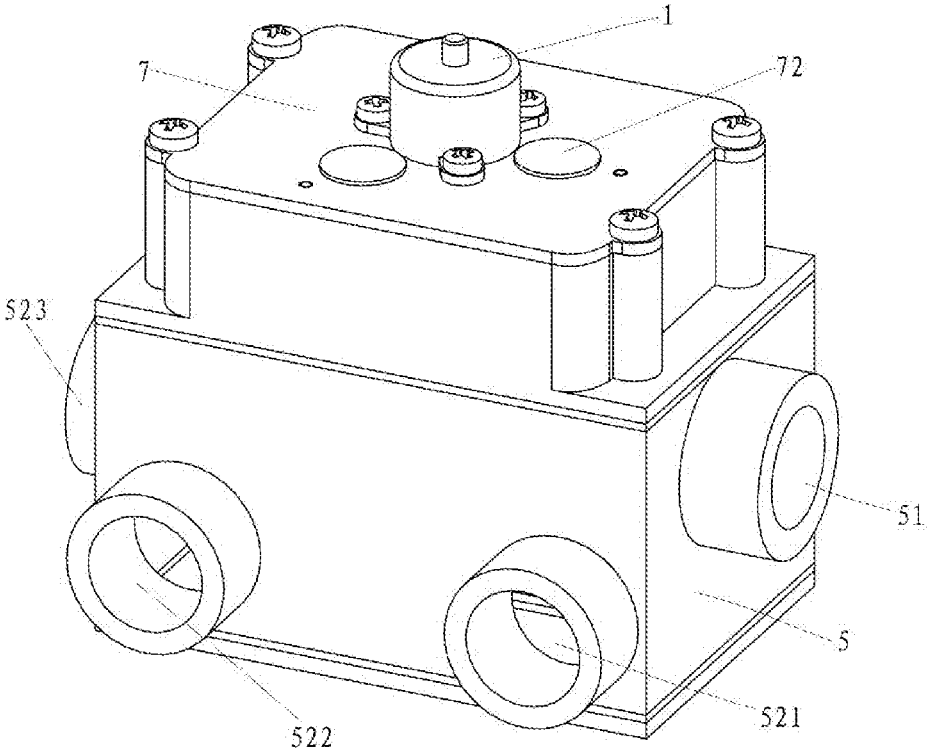
FIG. 12 is a three-dimensional view showing the structure of embodiment 5 of the present invention.
Figure 13:
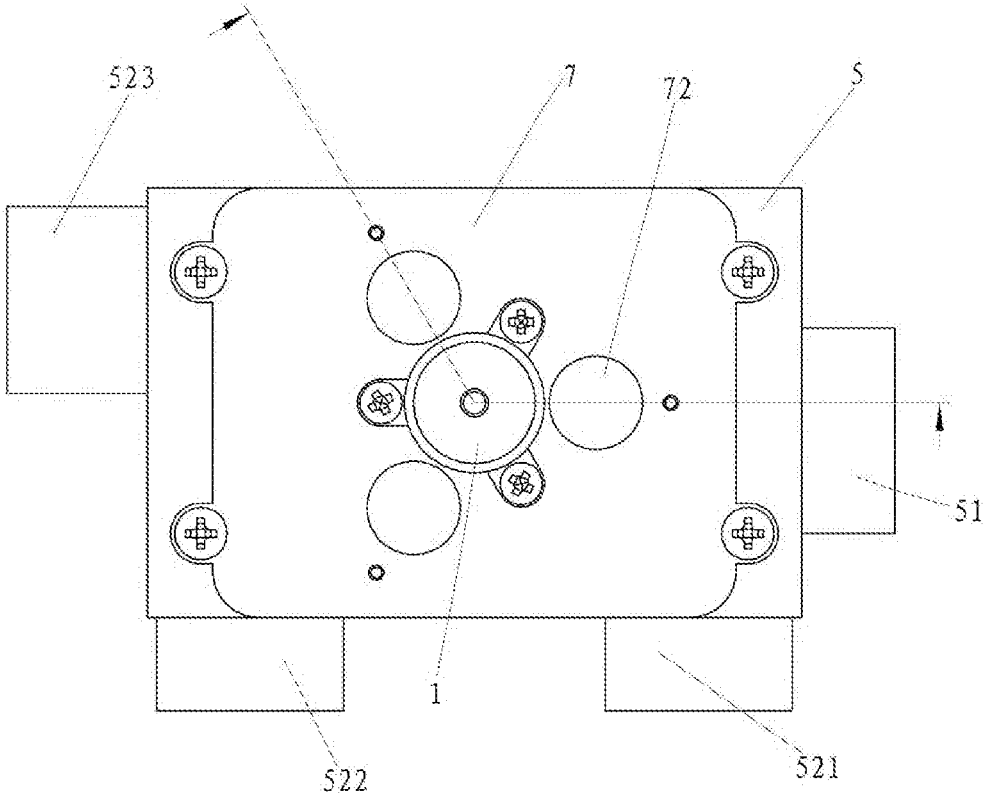
FIG. 13 is a top view of embodiment 5 of the present invention.
Figure 14:
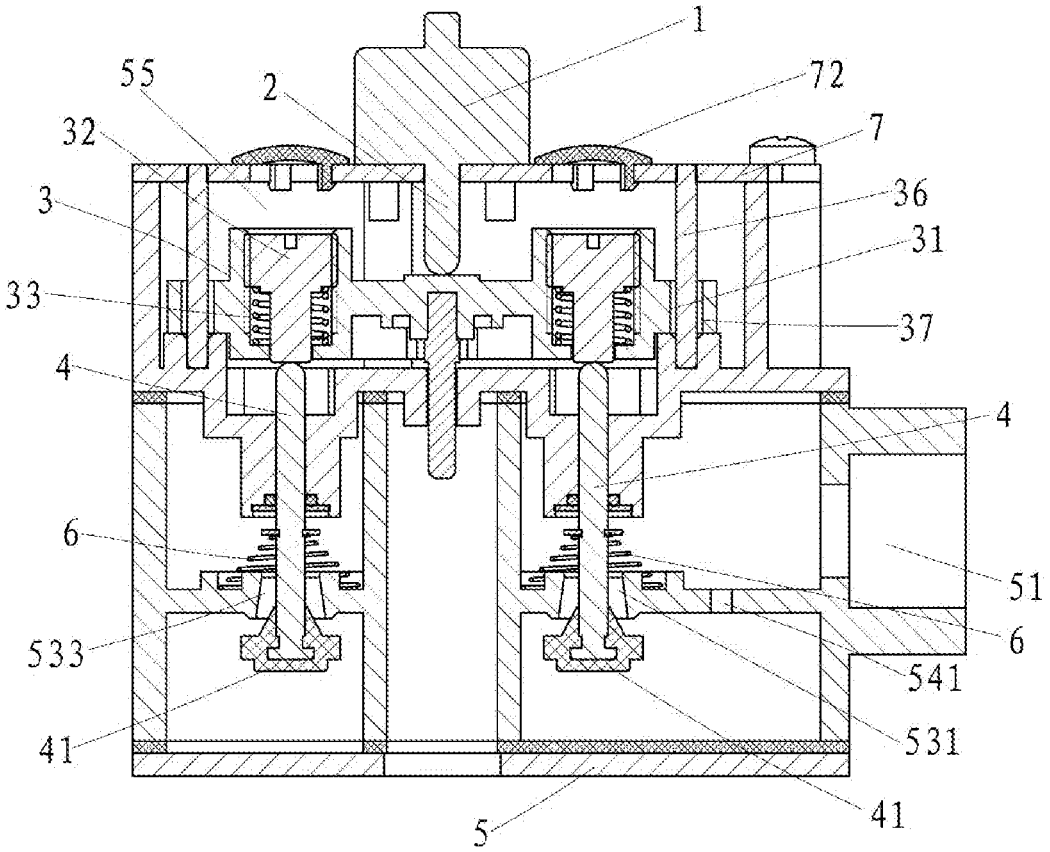
FIG. 14 is a cutaway view of embodiment 5 of the present invention in the position shown in FIG. 12 after being rotated.
Figure 15:
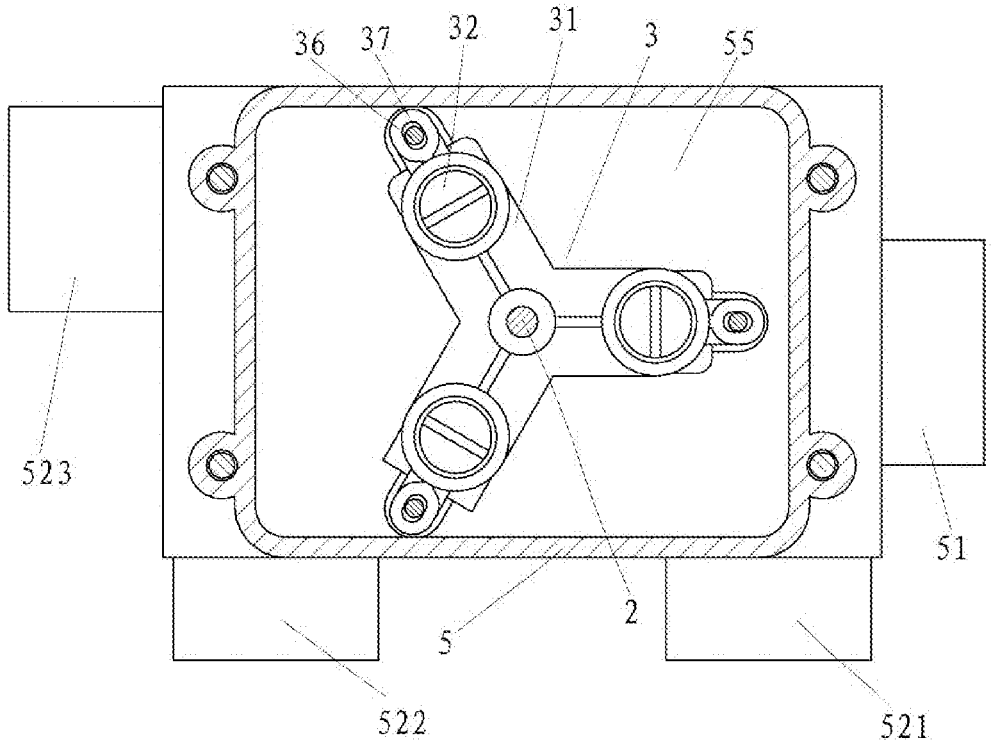
FIG. 15 shows the fit between the groove and the presser plate assembly on the valve body of embodiment 5 of the present invention.
Figure 16:
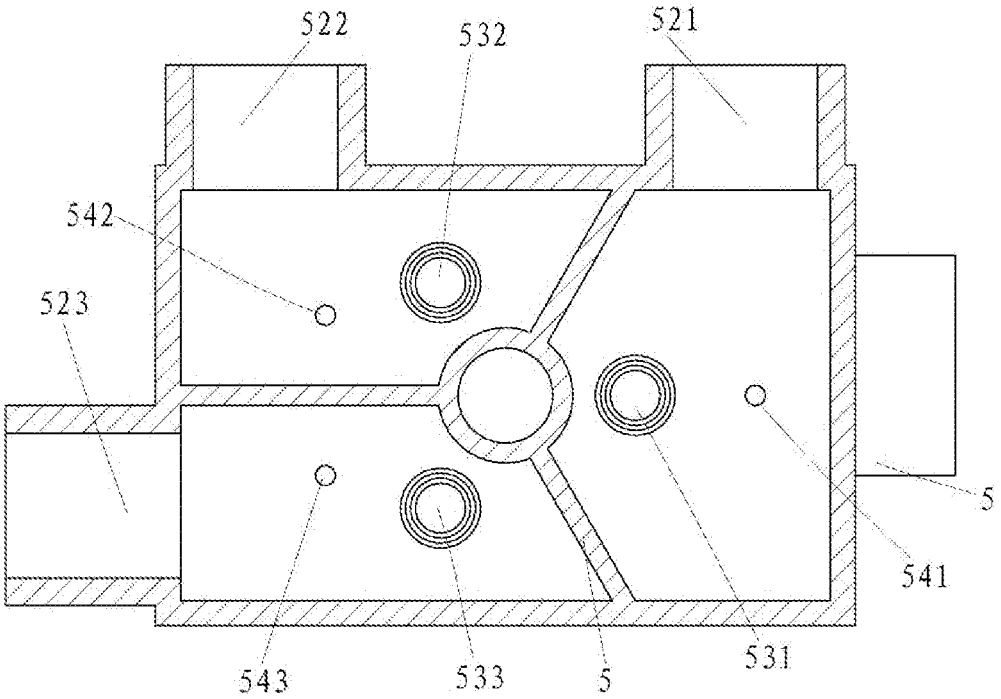
FIG. 16 is a cutaway view of the valve body of embodiment 5 of the present invention in the position of the regulating ports.

FIG. 11 shows a regulating mechanism for regulating flows from a is plurality of gas outlets in a fuel gas valve in this embodiment 4. Compared with the embodiment 3, the resetting device arranged between the regulating rod (4) and the valve body (5) is located below the first regulating port (531) and the second regulating port (532), that is, the resetting device (6) is arranged between the conical heads (41) and the valve body (5).

Embodiment 5

As shown in FIGS. 12 to 16, a regulating mechanism for regulating flows from two or more gas outlets in a fuel gas valve comprises an actuator (1), a push rod (2), a presser plate assembly (3), a regulating rod (4) and a valve body (5). In this embodiment 5, the actuator (1) is a linearly driving proportion electromagnet, the actuator (1) and the push rod (2) are integrated to become one unit, the valve body (5) is provided with one gas inlet (51) and two or more gas outlets, and in this embodiment 5, the valve body is provided with three gas outlets, namely, a first gas outlet (521), a second gas outlet (522), and a third gas outlet (523), and a first regulating port (531) from the gas inlet (51) to the first gas outlet (521), a second regulating port (532) from the gas inlet (51) to the second gas outlet (522), and a third regulating port (533) from the gas inlet (51) to the third gas outlet (523) are provided; a regulating rod (4) is respectively provided on the axes of the first regulating port (531), the second regulating port (532) and the third regulating port (533), the diameter of the head portion of the regulating rod (4) is greater than the diameter of the opening of said first regulating port (531), second regulating port (532), or third regulating port (533), the head portion of the regulating rod (4) is equipped with a conical head (41), the conical head (41) of the regulating rod (4) is a rubber sealing cushion fitted onto the head portion of the regulating rod (4), a resetting device (6) is provided between the regulating rod (4) and the valve body (5), and in this embodiment 5, the resetting device (6) is a compression spring arranged between each regulating rod (4) and the first regulating port (531), second regulating port (532) or third regulating port (533), the first regulating port (531), the second regulating port (532) and the third regulating port (533) are symmetrically arranged around the push rod (2), the actuator (1) directly drives the push rod (2) to move linearly and is arranged on the other side of the presser plate assembly (3), opposite to the regulating rods (4), the presser plate assembly (3) comprises a presser plate (31) and is arranged on the end portion of the regulating rod (4), the end portion of the regulating rod (4) is spherical, and the push rod (2) and the presser plate assembly (3) are connected via contact. In this embodiment 5, a regulating device is provided in a position corresponding to said regulating rod (4) on the presser plate assembly (3), said regulating device comprises a regulating rod pressing head (32), and the surface of the head portion of the regulating rod pressing head (32) is pressed on the end portion of the regulating rod (4), and the end portion of the regulating rod pressing head (32) is a straight slot. The regulating rod pressing head (32) is connected with the presser plate (31) through a screw thread, and a locking spring (33) is provided between the regulating rod pressing heads (32) and the presser plate (31).

A first minimum-flow port (541) is provided in parallel with the first regulating port (531) between the gas inlet (51) and the first gas outlet (521), a second minimum-flow port (542) is provided in parallel with the second regulating port (532) between the gas inlet (51) and the second gas outlet (522), and a third minimum-flow port (543) is provided in parallel with the third regulating port (533) between the gas inlet (51) and the third gas outlet (523).

A groove (55) is provided in the valve body (5) and the presser plate is arranged inside the groove (55), a presser-plate cover plate (7) is provided outside the presser plate assembly (3), an operating port (71) is provided on the presser-plate cover plate (7), an operating cover (72) is provided on the operating port (71), and the operating cover (72) is installed inside the operating ports (71).

When the regulating mechanism works, the actuator (1) drives the push rod (2) to move upward, and the push rod (2) pushes the presser plate assembly (3) to move upward, and the upward movement of the presser plate assembly (3) causes the regulating rods (4) to move upward under the action of the resetting devices (6), such that the opening degree of the passage formed between the conical head (41) of the regulating rod (4) and the first regulating port (531), second regulating port (532) or third regulating port (533) is reduced, that is, the flows passing through the first gas outlet (521), the second gas outlet (522) and the third gas outlet (523) are synchronously reduced.

When it is necessary to increase the flows, the actuator (1) drives in an opposite direction the push rod (2) to move downward, the presser plate assembly (3) is pressed to move downward, and the regulating rod (4) compress the resetting devices (6) to move downward together with the resetting device (6) such that the opening degree of the passage formed between the conical head (41) of the regulating rods (4) and the first regulating port (531), second regulating port (532) or third regulating port (533) is increased, that is, the flows passing through the first gas outlet (521), the second gas outlet (522) and the third gas outlet (523) are synchronously increased.

The gas coming out of each gas outlet (52) will additionally pass through an independent passage, and a switching device, for example, solenoid valve, is provided in said passage to control the opening and closing of said independent passage. Through said switching device, the fuel gas can be independently supplied to each burner of the fireplace and the flame can be regulated.

Since the first minimum-flow port (541), the second minimum-flow port (542) and the third minimum-flow port (543) are provided, when the regulating mechanism in the present embodiment is used to regulate the flows, the minimum flow from the first gas outlet (521) is the flow passing through the first minimum-flow port (541), the minimum flow from the second gas outlet (522) is the flow passing through the second minimum-flow port (542), and the minimum flow from the third gas outlet (523) is the flow passing through the second minimum-flow port (543).

In addition, owing to manufacturing errors during the manufacturing of is the regulating rods (4), the presser plate assembly (3) will press the regulating rods (4) to different degrees, and to solve this issue, the operating cover (72) can be removed from the corresponding operating port (71) and a tool such as a straight screwdriver can be used to rotate the regulating rod pressing head (32) to adjust the relative height of the surface of the head portion of the regulating rod pressing head (32) relative to the surface of the presser plate (31) to compensate for the manufacturing errors of the regulating rods (4) so that the presser plate assembly (3) can press the regulating rods (4) to the same degree and the opening degrees of the first regulating port (531), the second regulating port (32) and the third regulating port (533) can be the same or of the same ratio. In addition, since the locking spring (33) is provided, the regulating rod pressing heads (32) can be locked right after its height is adjusted and will not be loosened because of the threaded connection between the regulating rod pressing head (32) and the presser plate (31).

The presser plate assembly (3) is further provided with a guide rod (36) and a guide hole (37). The guide rod (36) passes through the guide hole (37) and is fixed onto the valve body (5) so that, when the push rod (2) drives the presser plate assembly (3) to move up and down, the positioning guide of the guide rod (36) can prevent the presser plate assembly (3) from rotating askew.

Embodiment 6

Figure 17:
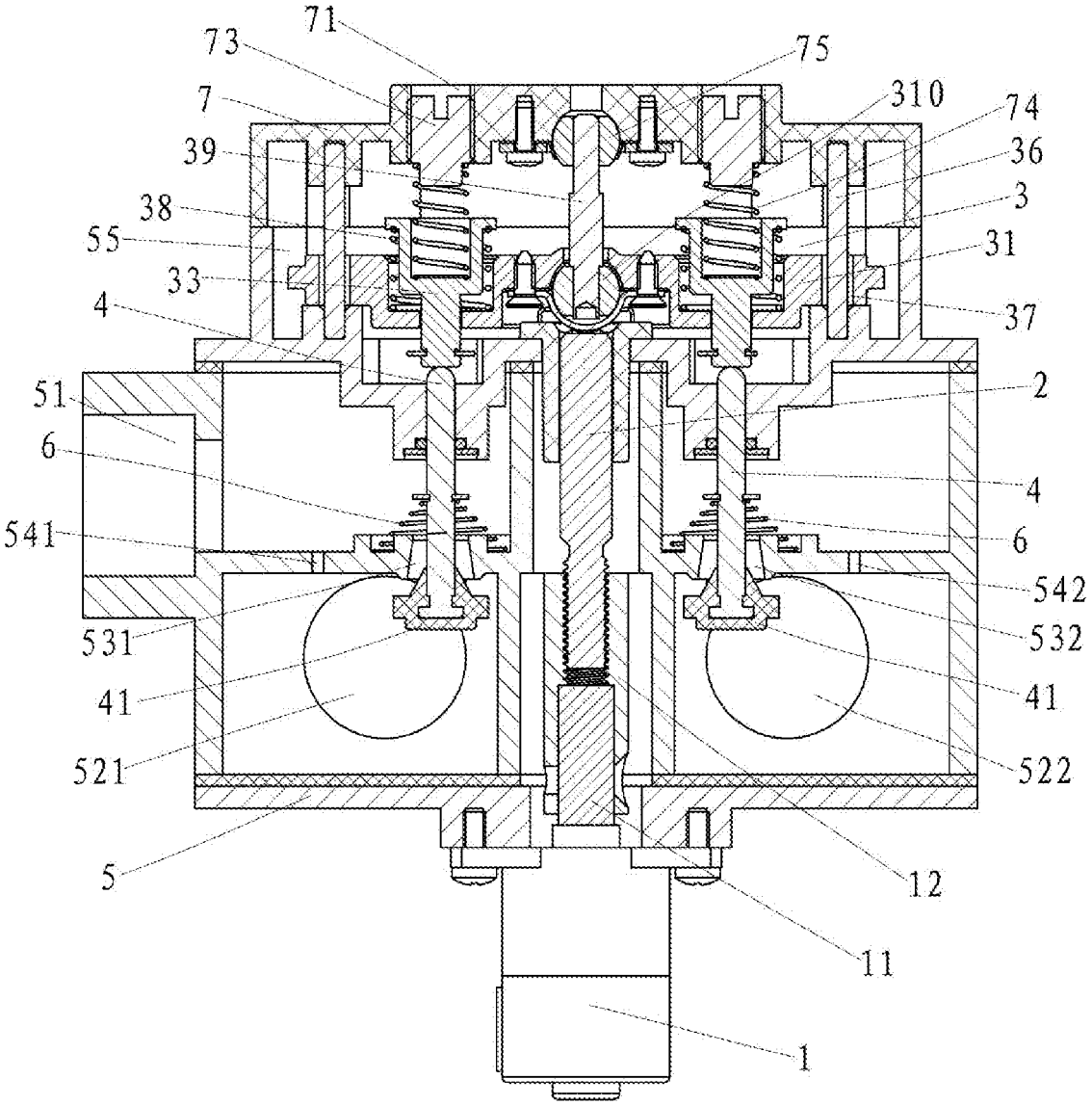
FIG. 17 is a cutaway view of embodiment 6 of the present invention in the position where the flows are maximum.
Figure 18:
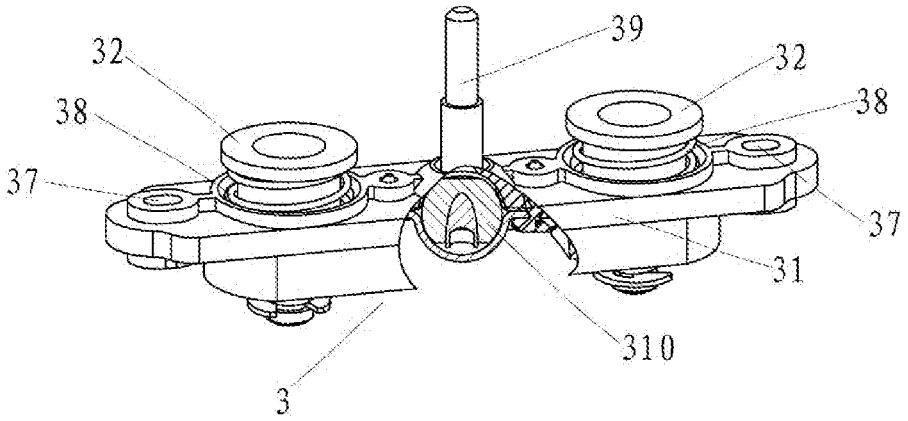
FIG. 18 is a three-dimensional view showing the structure of the presser plate assembly in embodiment 6 of the present invention.
Figure 19:
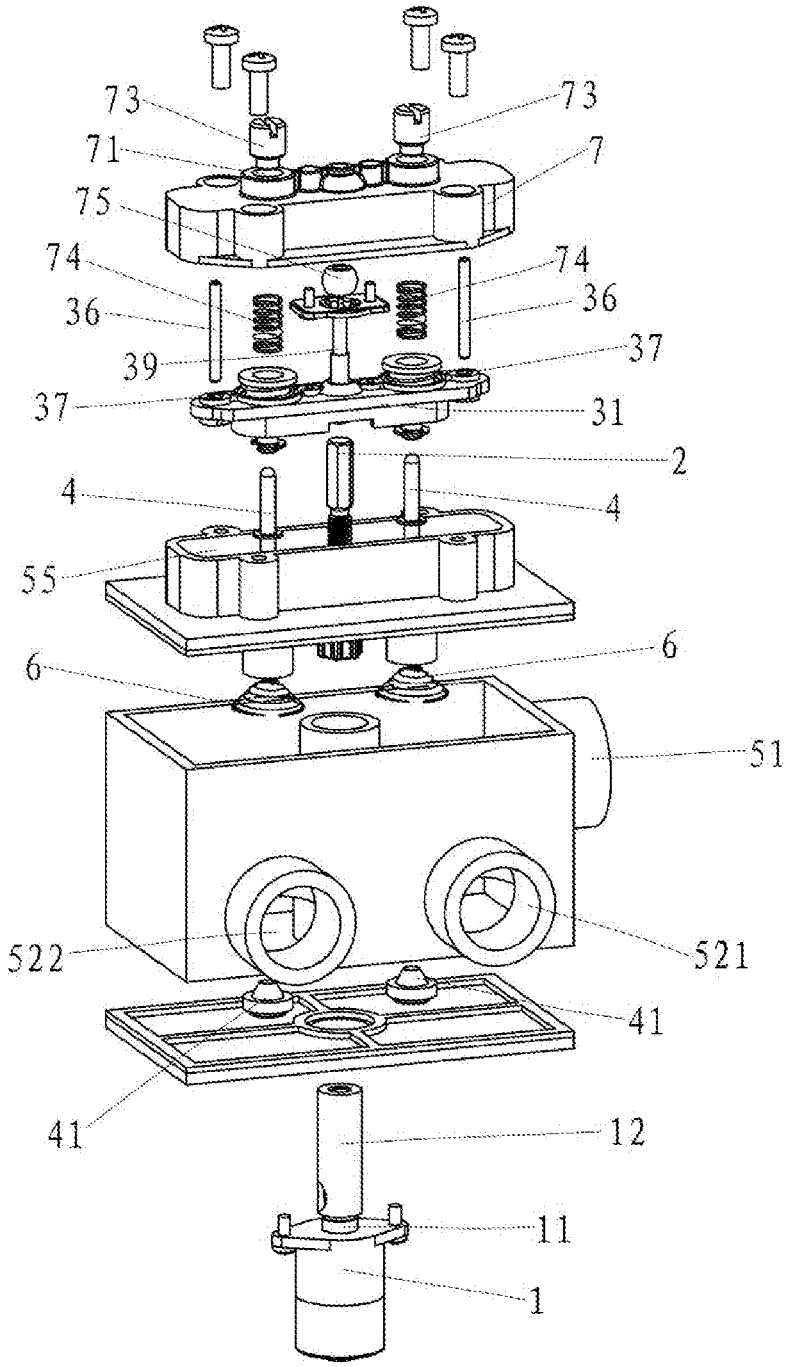
FIG. 19 is an exploded view showing the structure of embodiment 6 of the present invention.

As shown in FIGS. 17 to 19, a regulating mechanism for regulating flows from a plurality of gas outlets in a fuel gas valve comprises an actuator (1), a push rod (2), a presser plate assembly (3), a regulating rod (4) and a valve body (5). In this embodiment 6, the actuator (1) is a rotationally driving motor, the valve body (5) is provided with one gas inlet (51) and two or more gas outlets, and in this embodiment 6, the valve body is provided with two gas outlets, namely, a first gas outlet (521) and a second gas outlet (522), and a first regulating port (531) from the gas inlet (51) to the first gas outlet (521) and a second regulating port (532) from the gas inlet (51) to the second gas outlet (522) are provided; a regulating rod (4) is respectively provided on the axes of is the first regulating port (531) and the second regulating port (532), the diameter of the head portion of the regulating rod (4) is greater than the diameter of the opening of said first regulating port (531) or second regulating port (532), the head portion of the regulating rod (4) is equipped with a conical head (41), the conical head (41) of the regulating rod (4) is a rubber sealing cushion fitted onto the head portion of the regulating rod (4), a resetting device (6) is provided between each regulating rod (4) and the first regulating port (531) or the second regulating port (532), and in this embodiment 6, the resetting device (6) is a compression spring arranged between the regulating rod (4) and the first regulating port (531) or the second regulating port (532), the first regulating port (531) and the second regulating port (532) are symmetrically arranged around the push rod (2), the output shaft (11) of the actuator (1) and the push rod (2) are coaxially arranged, the output shaft (11) is connected to the push rod (2) with a commutator (12), the presser plate assembly (3) comprises a presser plate (31) and is arranged on the end portion of the regulating rod (4), the push rod (2) and the presser plate assembly (3) are connected via contact, and the push rod (2) and the regulating rod (4) are located on the same side of the presser plate assembly (3). In this embodiment 6, a regulating device is provided in a position corresponding to said regulating rod (4) on the presser plate assembly (3), the regulating device comprises a regulating rod pressing head (32), the surface of the head portion of the regulating rod pressing head (32) is pressed on the end portion of the regulating rod (4), the end portion of the regulating rod (4) is spherical, a first balancing spring (38) is provided between the regulating rod pressing heads (32) and the presser plate (31), the presser plate assembly (3) is further provided with a second guide rod (39), the second guide rod (39) is connected to the presser plate with a first spherical bearing (310), a groove (55) is provided in the valve body (5), the presser plate assembly (3) is arranged inside the groove (55), a presser-plate cover plate (7) is provided outside the presser plate assembly (3), an operating port (71) is provided on the presser-plate cover plate (7), a regulating screw (73) is is provided on the operating port (71), the end portion of the regulating screw (73) is a straight slot, and a second balancing spring (74) is provided between the regulating screw (71) and the regulating rod pressing head (32). A second spherical bearing (75) is further provided on the presser-plate cover plate (7), and the end portion of the second guide rod (39) is inserted into the inner hole in the second spherical bearing (75).

In this embodiment 6, the elastic forces of the first balancing spring (38) and the second balancing spring (74) are equal, the rigidity of the second balancing spring (74) is 1~10 times that of the first balancing spring (38), and the elastic force of the second balancing spring (74) is by far greater than the elastic force of the resetting device (6).

A first minimum-flow port (541) is provided in parallel with the first regulating port (531) between the gas inlet (51) and the first gas outlet (521), and a second minimum-flow port (542) is provided in parallel with the second regulating port (532) between the gas inlet (51) and the second gas outlet (522).

When the regulating mechanism works, the output shaft (11) of the actuator (1) rotates and drives the push rod (2) to move upward with the aid of the commutator (12), and the push rod (2) pushes the presser plate assembly (3) to move upward to compress the first balancing spring (38) and the second balancing spring (74), and the upward movement of the presser plate assembly (3) causes the regulating rods (4) to move upward under the action of the resetting devices (6), such that the opening degree of the passage formed between the conical head (41) of the regulating rod (4) and the first regulating port (531) or second regulating port (532) is reduced, that is, the flows passing through the first gas outlet (521) and the second gas outlet (522) are synchronously reduced.

When it is necessary to increase the flows, the output shaft (11) of the actuator (1) rotates in an opposite direction and the push rod (2) is driven to move downward with the aid of the commutator (12), and since the elastic force of the second balancing spring (74) is by far greater than the elastic force is of the resetting device (6), the presser plate assembly (3) is pressed to move downward to compress the resetting device (6) under the action of the second balancing spring (74) to cause the regulating rod (4) to move downward together so that the opening degree of the passage formed between the conical head (41) of the regulating rod (4) and the first regulating port (531) or the second regulating port (532) is increased, that is, the flows passing through the first gas outlet (521) and the second gas outlet (522) are synchronously increased.

The gas coming out of each gas outlet (52) will additionally pass through an independent passage, and a switching device, for example, solenoid valve, is provided in said passage to control the opening and closing of said independent passage. Through said switching device, the fuel gas can be independently supplied to each burner of the fireplace and the flame can be regulated.

Since the first minimum-flow port (541) and the second minimum-flow port (542) are provided, when the regulating mechanism in the present embodiment is used to regulate the flows, the minimum flow from the first gas outlet (521) is the flow passing through the first minimum-flow port (541), and the minimum flow from the second gas outlet (522) is the flow passing through the second minimum-flow port (542).

In addition, owing to manufacturing errors during the manufacturing of the regulating rods (4), the presser plate assembly (3) will press the regulating rods (4) to different degrees, and to solve this issue, a tool such as a straight screwdriver can be used to rotate the regulating rod pressing head (32) to adjust the pre-compressed lengths of the first balancing spring (38) and the second balancing spring (74), thereby adjusting the relative height of the surface of the head portion of the regulating rod pressing head (32) relative to the surface of the presser plate (31) to compensate for the manufacturing errors of the regulating rods (4) so that, the presser plate assembly (3) can press the regulating rods (4) to the same degree and the opening degrees of the first regulating port (531) and the second regulating port (532) can be the same or of is the same ratio.

Since the first spherical bearing (310) and the second spherical bearing (75) are provided, the second guide rod (39) can be prevented from getting stuck, which may happen when the central holes in the presser plate (31) and the presser-plate cover plate (7) are offset.

The presser plate assembly (3) is further provided with a guide rod (36) and a guide hole (37). The guide rod (36) passes through the guide hole (37) and is fixed onto the valve body (5). When the push rod (2) drives the presser plate assembly (3) to move up and down, the positioning guide of the guide rod (36) can prevent the presser plate assembly (3) from rotating askew.

In summary, the above-mentioned embodiments are not restricting embodiments of the present invention, and all modifications or equivalent variants made by those skilled in the art without departing substantially from the present invention should fall within the technical scope of the present invention.

What is claimed is:

1. A regulating mechanism for regulating flows from a plurality of gas outlets in a fuel gas valve, comprising an actuator, a push rod, a presser plate assembly, a regulating rod and a valve body, wherein the number of said regulating rods is two or more, said actuator, push rod, presser plate assembly and regulating rods are all arranged on the valve body, said valve body is provided with one gas inlet and two or more gas outlets, a regulating port is provided between said gas inlet and said at least two gas outlets from which the flow needs to be regulated, a regulating rod is provided in each of said regulating ports, a resetting device is provided between said regulating rod and said valve body, said presser plate assembly comprises a presser plate, and said presser plate can simultaneously press all of said regulating rods through a movement of the actuator when the regulating mechanism works; a guide device is provided between said presser plate and said valve body.

2. The regulating mechanism for regulating flows from a plurality of gas outlets in a fuel gas valve as claimed in claim 1, wherein said regulating ports are arranged around said push rod, and the output shaft of said actuator and said push rod are coaxially arranged.

3. The regulating mechanism for regulating flows from a plurality of gas outlets in a fuel gas valve as claimed in claim 1, wherein a regulating device is provided at least in a position corresponding to one said regulating rod on said presser plate assembly, said regulating device comprises a regulating rod pressing head, and the surface of the head portion of each said regulating rod pressing head is pressed on the end portion of said regulating rod.

4. The regulating mechanism for regulating flows from a plurality of gas outlets in a fuel gas valve as claimed in claim 2, wherein the relative height of the surface of the head portion of said regulating rod pressing head relative to the surface of the presser plate is adjustable.

5. The regulating mechanism for regulating flows from a plurality of gas outlets in a fuel gas valve as claimed in claim 1, wherein the head portion of said regulating rod is equipped with a conical head.

6. The regulating mechanism for regulating flows from a plurality of gas outlets in a fuel gas valve as claimed in claim 5, wherein the conical head of said regulating rod is a conical rubber sealing element and said rubber sealing element is fitted onto the head portion of said regulating rod.

7. The regulating mechanism for regulating flows from a plurality of gas outlets in a fuel gas valve as claimed in claim 1, wherein said actuator and said push rod can be integrated to become a linearly driving actuator.

8. The regulating mechanism for regulating flows from a plurality of gas outlets in a fuel gas valve as claimed in claim 1, wherein said regulating port has a certain baseline flow, which means that, when the flow is regulated to a minimum flow through said regulating port, said regulating port is not completely closed, or said regulating port is set to have a minimum flow.

9. The regulating mechanism for regulating flows from a plurality of gas outlets in a fuel gas valve as claimed in claim 1, wherein when the flow is regulated to a minimum flow through said regulating port, said regulating port is completely closed, but a minimum-flow port is provided in parallel with said regulating port between said gas inlet and said gas outlet and a minimum flow from said gas inlet to each of said gas outlets is determined by said minimum-flow port.

10. The regulating mechanism for regulating flows from a plurality of gas outlets in a fuel gas valve as claimed in claim 1, wherein a groove is provided in said valve body and said presser plate assembly is embedded into said groove.

11. The regulating mechanism for regulating flows from a plurality of gas outlets in a fuel gas valve as claimed in claim 10, wherein a presser-plate cover plate is provided outside said presser plate assembly, and said presser-plate cover plate and said groove encapsulate said presser plate assembly inside said valve body.

12. The regulating mechanism for regulating flows from a plurality of gas outlets in a fuel gas valve as claimed in claim 11, wherein an operating port is provided on said presser-plate cover plate.

13. The regulating mechanism for regulating flows from a plurality of gas outlets in a fuel gas valve as claimed in claim 12, wherein an operating cover is provided on said operating port and said operating cover seal up a space where said presser plate assembly is located.

14. The regulating mechanism for regulating flows from a plurality of gas outlets in a fuel gas valve as claimed in claim 4, wherein a regulating rod pressing head is connected with said presser plate through a screw thread.

15. The regulating mechanism for regulating flows from a plurality of gas outlets in a fuel gas valve as claimed in claim 4, wherein a locking spring is provided between said regulating rod pressing head and said presser plate.

* * * * *